US010436558B1

(12) United States Patent
Gilliam

(10) Patent No.: US 10,436,558 B1
(45) Date of Patent: Oct. 8, 2019

(54) PREFORMED FRAGMENT WARHEAD HAVING MINIMAL FRAGMENT VELOCITY DISTRIBUTION

(75) Inventor: Jason C. Gilliam, Huntsville, AL (US)

(73) Assignee: The United States of America as represented by the Secretary of the Army

( * ) Notice: Subject to any disclaimer, the term of this patent is extended or adjusted under 35 U.S.C. 154(b) by 3459 days.

(21) Appl. No.: 12/322,954

(22) Filed: Dec. 18, 2008

(51) Int. Cl.
*F42B 12/22* (2006.01)

(52) U.S. Cl.
CPC ..... *F42B 12/22* (2013.01)

(58) Field of Classification Search
USPC ..... 102/389, 475, 491, 492, 494, 495, 496, 102/497
See application file for complete search history.

(56) References Cited

U.S. PATENT DOCUMENTS

| | | | |
|---|---|---|---|
| 1,575,716 | A | 5/1925 | Pavek |
| 3,796,157 | A | 3/1974 | Anderson |
| 4,760,793 | A | 8/1988 | Herring, III |
| 5,235,916 | A | 8/1993 | Winger |

*Primary Examiner* — Benjamin P Lee
(74) *Attorney, Agent, or Firm* — Michael K. Gray

(57) ABSTRACT

A preformed warhead is provided with a casing having a front section and a rear section. A plurality of target piercing fragments is arranged at the front section. The density of a given fragment diminishes the further the given fragment is from a centerline of the warhead. An initiating point located on the centerline is positioned at the rear section of the warhead. An explosive charge is positioned between the initiating point and the target piercing fragments. Upon detonation of the warhead, the explosive wave propagates in a radial fashion such that the fragments receiving the impact of the explosive force soonest and most directly are those fragments closest to the centerline. Thus, a substantially planar velocity profile of all the fragments is achieved.

10 Claims, 2 Drawing Sheets

PREFORMED FRAGMENT WARHEAD HAVING MINIMAL FRAGMENT VELOCITY DISTRIBUTION

DEDICATORY CLAUSE

The invention described herein may be manufactured, used and licensed by or for the U.S. Government for Governmental Purposes without payment of any royalties thereon.

BACKGROUND OF THE INVENTION

I. Field of the Invention

The present invention pertains to the field of warhead design. More particularly, the present invention pertains to a warhead having regions of target-piercing fragments of different densities which upon detonation travel to a target at substantially the same speed so as to arrive at the target at substantially the same time.

II. Discussion of the Background

Preformed fragment warheads consist of an array of fragments to be projected toward a target when the warhead explosive is initiated. Because of the symmetries of the warhead, the fragments closest to a single initiation point travel faster than the fragments further away from the initiation point. The velocity falls off with increasing distance from the warhead centerline in a parabolic or elliptical fashion according to the following estimate:

$$\frac{V}{V_{center}} = \frac{2}{3} + \frac{1}{3}\sqrt{1-(r/r_{max})^2} \quad (1)$$

where V=fragment velocity; and r=warhead radius.

The result is a distribution of fragment velocities along the warhead radius, with the fastest velocities being imparted to those fragments positioned at the warhead centerline and the slowest velocities being imparted to those fragments positioned the furthest radial distance away from the warhead centerline.

SUMMARY OF THE INVENTION

In the present invention, a preformed warhead includes a casing having a rear section and a forward section. An explosive charge is contained within the casing. The warhead includes a center region of fragments and a lateral region of fragments in lateral alignment with the center region of fragments. The casing contains an initiation point located at the rear section of the casing. A centerline extends through the initiation point and the center region of fragments. The center region of fragments contains a plurality of fragments and the lateral region of fragments contains a plurality of fragments. The plurality of fragments in the center region of fragments has a higher density than the plurality of fragments in the lateral region of fragments. The center region of fragments and the lateral region of fragments are both located at the forward section of said casing.

In a preferred embodiment, the density of a given fragment diminishes the further the given fragment is from the centerline.

DESCRIPTION OF THE DRAWINGS

A more complete appreciation of the invention and many of the attendant advantages thereof will be readily obtained as the same becomes better understood by reference to the following detailed description when considered in connection with the accompanying drawings.

DETAILED DESCRIPTION

Figure 1:
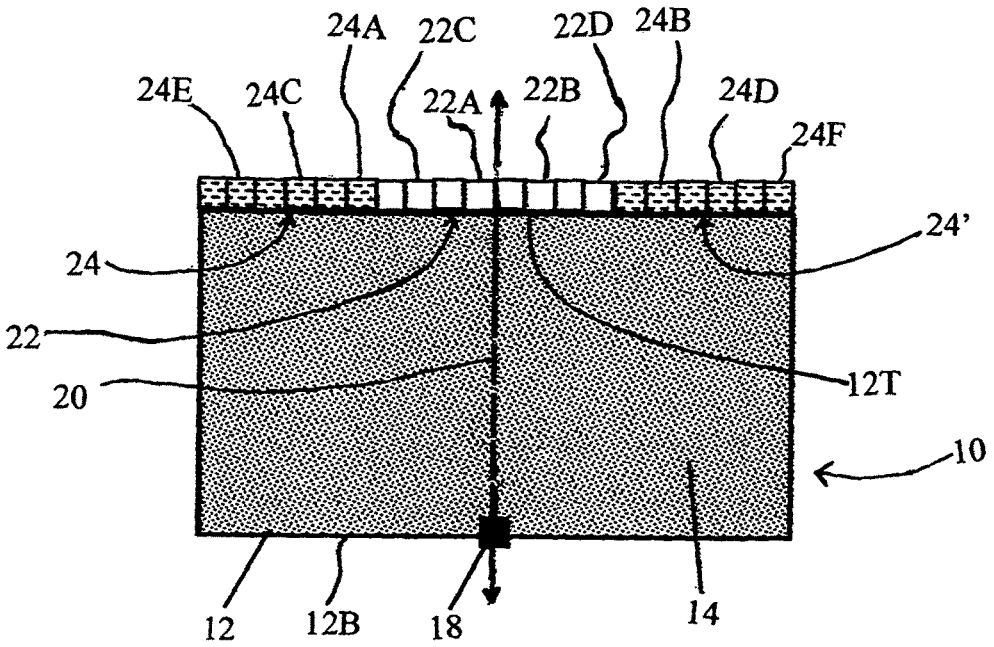
FIG. 1 is cross-sectional illustration of the warhead of the present invention.

With reference to FIG. 1, the preformed fragment warhead 10 of the present invention is provided with a casing 12 having a rear or bottom section 12B and a forward or top section 12T. The casing 12 is filled with an explosive charge 14. A centerline 20 extends through the top section 12T and the bottom section 12B of the casing 12. A center region of fragments 22 is located at the top section of the casing 12B. The center region of fragments 22 is positioned on or radially proximate to the centerline 20. The center region of fragments 22 is surrounded by a region of lateral fragments 24, 24'.

The respective fragments in the region of lateral fragments 24, 24' are positioned a greater radial distance from the centerline 20 than are the respective fragments in the center region of fragments 22. (In FIGS. 1 and 2, lateral fragments 24 are those fragments shown to the left of centerline 20 and lateral fragments 24' are those fragments shown to the right of centerline 20). In the present invention, the casing 12 is of a cylindrical or rectangular shape such that the preformed fragments are symmetrically arranged.

An initiating point 18 is located at the bottom section 12B of casing 12 on the centerline 20. The initiating point 18 is the origin point of detonation caused by activation of a fuse and detonator (not shown). Upon detonation, explosion waves 26 A, 26B, 26C (FIG. 2) propagate from the initiating point 18 toward the center region 22 and lateral region 24, 24' of fragments. Those skilled in the art will recognize that many different types of fuzes and detonators could be used to initiate the warhead at initiating point 18.

In accordance with the present invention, the fragments in the center region 22 have a greater density than the fragments in the lateral region 24, 24'. That is to say that the fragments in the lateral region 24, 24' are less dense than the fragments in the center region 22.

Figure 2:
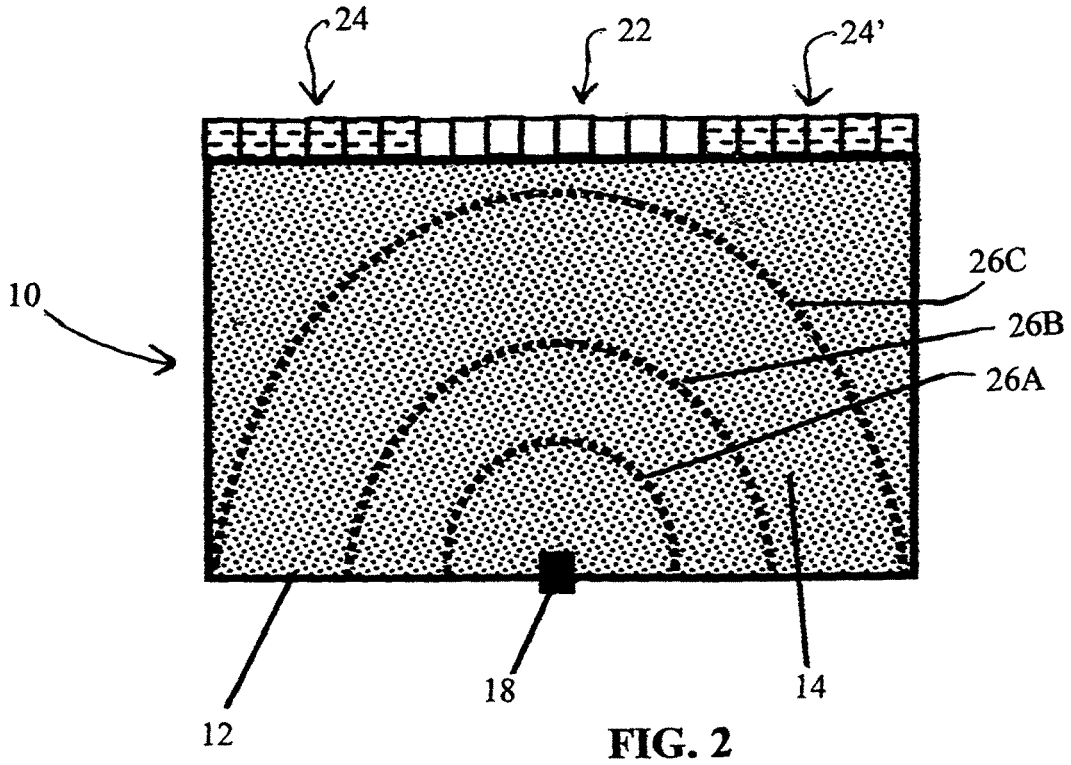
FIG. 2 is a cross-sectional illustration of the warhead of the present invention showing explosive wave propagation immediately after detonation.

As can be appreciated from FIG. 2, upon detonation, the fragments located closest to the centerline 20 will receive shock wave effects sooner and will experience more direct force impact than fragments located further from the centerline 20.

By placing the fragments of higher density in the center region 22 and the less dense fragments in the lateral region 24, 24', after detonation all of the fragments travel at substantially the same speed.

Preferably the fragments are arranged such that the density of a given fragment diminishes the further away from the centerline 20 a fragment is. Thus, the fragment 22A is more dense than fragment 22B. Fragment 22B is more dense than fragment 22C and fragment 22D is less dense than fragment 22C. Preferably, fragments 22A, 22B, 22C and 22D can be fragments arranged in a row or circle of like fragments.

Similarly in the lateral region 24, 24', fragment 24A preferably has a greater density than fragment 24B and fragment 24B has a greater density than fragment 24C. Fragment 24C has a greater density than fragment 24D and fragment 24D has a greater density than fragment 24E. Fragment 24E has a greater density than fragment 24F. Preferably, fragments 24A, 24B, 24C, 24D, 24E, and 24F are arranged in a row or circle of like fragments. The fragments contained in the center region 22 would, for example, be made of dense materials such as tungsten, tantalum, molybdenum, etc., whereas the fragments in region 24, 24' would be made of less dense materials, e.g., steel. Metal alloys and composite materials could be used in accordance with the present invention.

Figure 3:
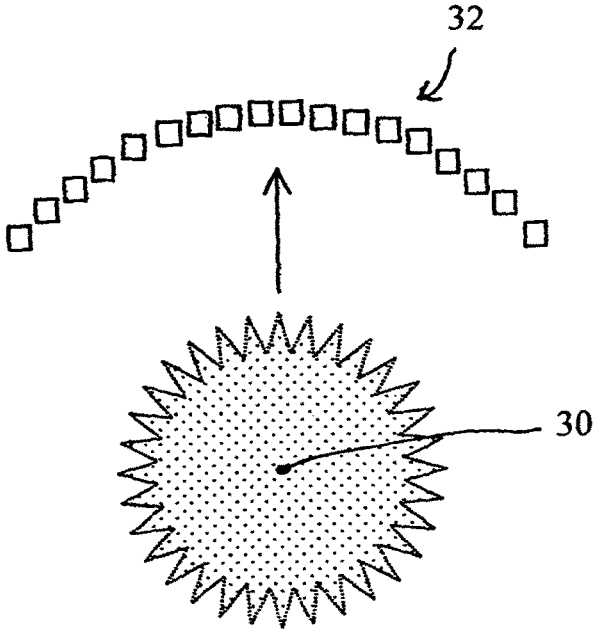
FIG. 3 (Prior Art)
FIG. 3 is a fragmentation profile of a prior art warhead.

With reference to FIG. 3, the prior art illustration demonstrates a bowed or arcuate fragment profile 32 resulting from an explosive force 30 in a prior art warhead. The distribution of fragment velocities along the warhead radius result in a non-planar fragment pattern propagating toward the target.

Figure 4:
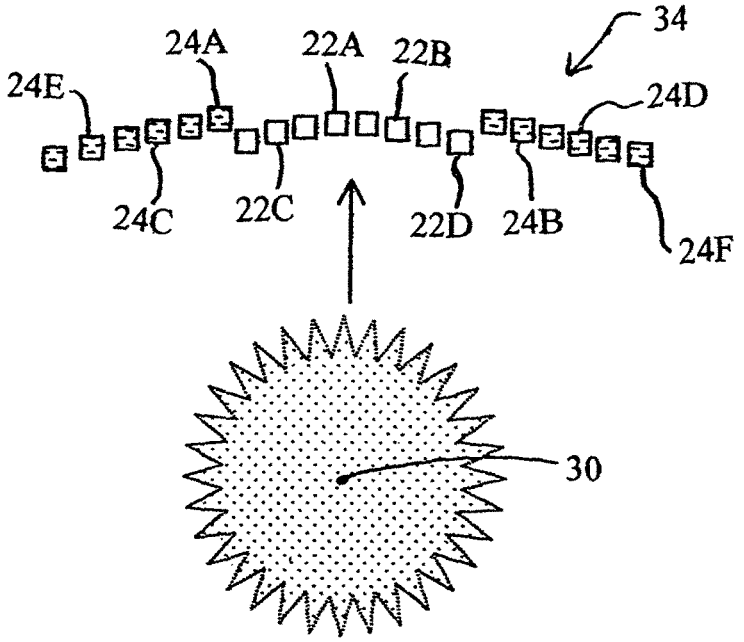
FIG. 4 is a fragmentation profile of the warhead of the present invention.

By contrast, in FIG. 4, in accordance with the present invention, the explosive force 30 results in a substantially planar or linear fragment profile 34. Fragments 22A, 22B, 22C, 22D, 24A, 24B, 24C, 24D, 24E, 24F are aligned in a substantially linear fashion upon detonation of the warhead.

In many situations, a planar wave of fragments is desirable to maximize the probability of hitting a target. In the prior art, planar waves have been generated by the use of multiple initiation points or by a wave shaper in the explosive charge which flattens the explosive wave prior to reaching the fragments. In the present invention, a desired linear or planar profile of fragments can be achieved without the complexity of multiple initiation points or a wave shaper. The present invention achieves a minimum variance in the fragment velocities across the array of fragments resulting in a planar wave of fragments propagating toward the target of interest.

Modifications are possible without deviating from the spirit of the present invention. Accordingly, the scope of the invention is limited only by the claim language which follows hereafter.

What is claimed is:

1. A warhead comprising:

a casing having a rear section and a forward section;

an explosive charge contained within said casing;

a center region of fragments;

a lateral region of fragments in lateral alignment with said center region of fragments;

an initiation point; and wherein a centerline extends through said initiation point and said center region of fragments, said center region of fragments containing a plurality of fragments and said lateral region of fragments containing a plurality of fragments, said plurality of fragments in said center region of fragments having a higher density than said plurality of fragments in said lateral region of fragments.

2. A warhead according to claim 1, wherein:

said lateral region of fragments surrounds said center region of fragments.

3. A warhead according to claim 2, wherein:

said center region of fragments is located at the forward section of said casing and said lateral region of fragments is located at the forward section of said casing.

4. A warhead according to claim 3, wherein:

in said plurality of fragments of said center region of fragments the density of a respective fragment in said center region of fragments diminishes the further the respective fragment is from the centerline.

5. A warhead according to claim 4, wherein:

in said plurality of fragments of said lateral region of fragments the density of a given fragment in said lateral region of fragments diminishes the further the given fragment is from the centerline.

6. A warhead according to claim 5, wherein:

said initiation point includes a detonator connected to a fuze.

7. A warhead according to claim 5, wherein:

said initiation point is located at the rear section of said casing.

8. A warhead according to claim 2, wherein:

upon detonation of the warhead, a substantially planar velocity profile of fragments is achieved.

9. A warhead according to claim 2, wherein:

the warhead is a preformed warhead.

10. A warhead according to claim 2, wherein:

said lateral region of fragments is located radially outside of said center region of fragments.

* * * * *